US005803163A

United States Patent [19]

Goulet

[11] Patent Number: 5,803,163

[45] Date of Patent: Sep. 8, 1998

[54] BEVERAGE COOLING COIL

[75] Inventor: Douglas P. Goulet, Big Lake, Minn.

[73] Assignee: IMI Cornelius Inc., Anoka, Minn.

[21] Appl. No.: 761,461

[22] Filed: Dec. 6, 1996

[51] Int. Cl.[6] ..... F28F 1/00

[52] U.S. Cl. ..... 165/172; 165/163

[58] Field of Search ..... 165/74, 163, 172

[56] References Cited

U.S. PATENT DOCUMENTS

| | | | |
|---|---|---|---|
| 1,882,116 | 10/1932 | Bryan | 165/163 X |
| 1,884,138 | 10/1932 | Newmier | 165/163 X |
| 2,657,020 | 10/1953 | Hofmeister | 165/172 |
| 2,660,410 | 11/1953 | Hofmeister | 165/163 |
| 5,332,033 | 7/1994 | Metzger | 165/163 |

*Primary Examiner*—Allen J. Flanigan
*Attorney, Agent, or Firm*—Sten Erik Hakanson

[57] ABSTRACT

The present invention comprises a cooling coil configuration that permits an extended length of coil in a smaller total volume of water bath utilized, than is seen in such coils in the prior art. The coil of the present invention is made from a continuous length of stainless steel tubing that is bent in a manner to provide for the desired configuration. In one embodiment, the full coil is made up of four sub-coils generated by bending the tube through a plurality of consecutive 180 degree or semi-circular arcs having straight tubular portions intervening there between. In order of bending, there is a first large arc, a second medium sized bend of smaller circular diameter than the large bend, three consecutive small bends all of the same size and of a further smaller diameter than the medium bend, a further medium sized loop the same dimension as the previous medium one, and ending with a large loop, again of the same dimension as the first large loop. The loops are collapsible partially within each other in a manner that conserves the total volume thereof.

1 Claim, 5 Drawing Sheets

24
18a
10
18
14
25
42
22
30
44
32
23
34
17
20a
15
15a
12
47
12a
20

50

25
24
54
56
10
22
23
52
44
53
32

BEVERAGE COOLING COIL

FIELD OF THE INVENTION

The present invention relates generally to heat exchange coils used in beverage dispensing machines, and in particular to the configuration of such coils.

BACKGROUND OF THE INVENTION

Beverage dispensing machines that utilize a cooled water bath for cooling of the beverages dispensed therefrom are well known in the art. The beverages, or their constituents, such as a syrup component and a carbonated water component as found in a dispenser of the post-mix type, are cooled by flowing through a heat exchange coil located in the dispenser water bath. Such coils are typically made of stainless steel and are submerged in the water bath so as to cool the beverage to the desired temperature as it flows from a source thereof to the dispensing valve. The coils must be long enough so that the beverage has adequate time to reach the desired temperature as it flows there through, particularly at the highest demand or flow rates of the beverage. However, there are significant external constraints on the size of the dispenser, and hence, the water bath volume. Moreover, the beverage coils must compete for space with other elements located in the water bath. Such dispensing machines typically utilize and ice-bank formed on refrigeration evaporator coils positioned in the water bath. Additionally, there will be an agitating means for circulating the water to provide for better heat exchange and uniform water bath temperature. In many cases, there can also be a carbonator located in the water bath. Thus, there is always a desire to utilize the given water bath space as efficiently as possible. Accordingly, it would be very desirable to have a beverage coil that permits increased heat exchange capacity for a given volume of water bath used.

SUMMARY OF THE INVENTION

The present invention comprises a unique cooling coil configuration that permits an extended length of coil in a smaller total volume of water bath utilized, than is seen in such coils in the prior art. The coil of the present invention is made from a continuous length of stainless steel tubing that is bent in a manner to provide for the desired configuration. In one embodiment, the full coil is made up of four sub-coils generated by bending the tube through a plurality of consecutive 180 degree or semi-circular arcs having straight tubular portions intervening there between. In order of bending, there is a first large arc, a second medium sized bend of smaller circular diameter than the large bend, three consecutive small bends all of the same size and of a further smaller diameter than the medium bend, a further medium sized loop the same dimension as the previous medium one, and ending with a large loop, again of the same dimension as the first large loop.

It was found that the above configuration of four sub-coils could be compressed together to form a coil having a resultant thickness dimension of only two coils, i.e. a thickness of twice the diameter of the tubing being used. This situation is in contrast with the prior art where the coil is bent in the manner of a spring. In such a situation, since each sub-coil is of the same dimension, the resulting minimum thickness thereof when fully compressed is equal to the diameter of the tubing times the number of sub-coils, e.g. with four sub-coils there would be a resultant width of four times the diameter of the tubing. The present invention provides for this reduction of overall thickness of one-half by the fact that it has two inner coils thereof that fit within an internal area defined by two larger end or outer coils when the whole coil is fully compressed.

DESCRIPTION OF THE DRAWINGS

A better understanding of the structure, function and objects and advantages of the present invention can be had by reference to the following detailed description which refers to the following figures, wherein.

DETAILED DESCRIPTION

Figure 1:
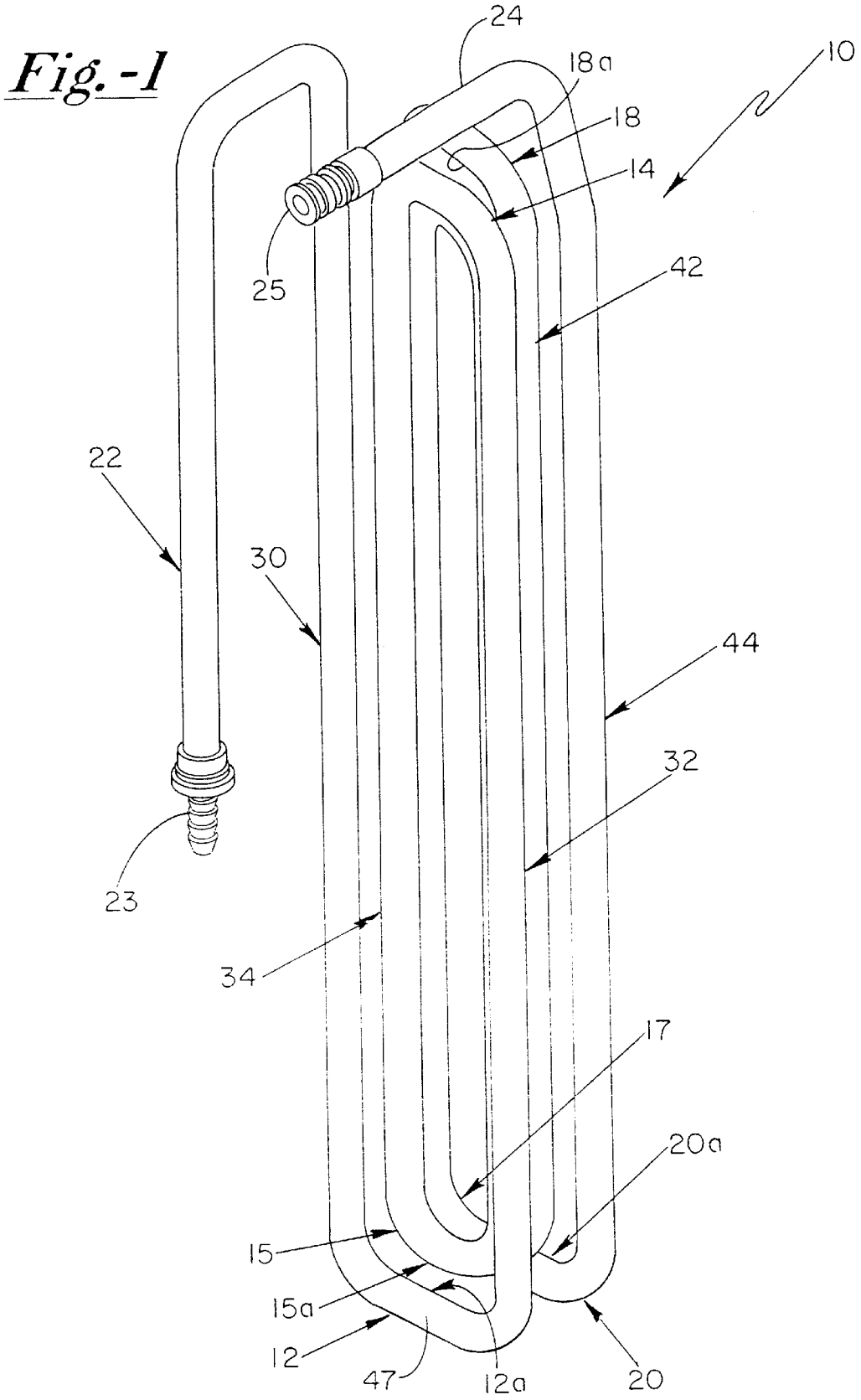
FIG. 1. shows a perspective view of the present invention.
Figure 2:
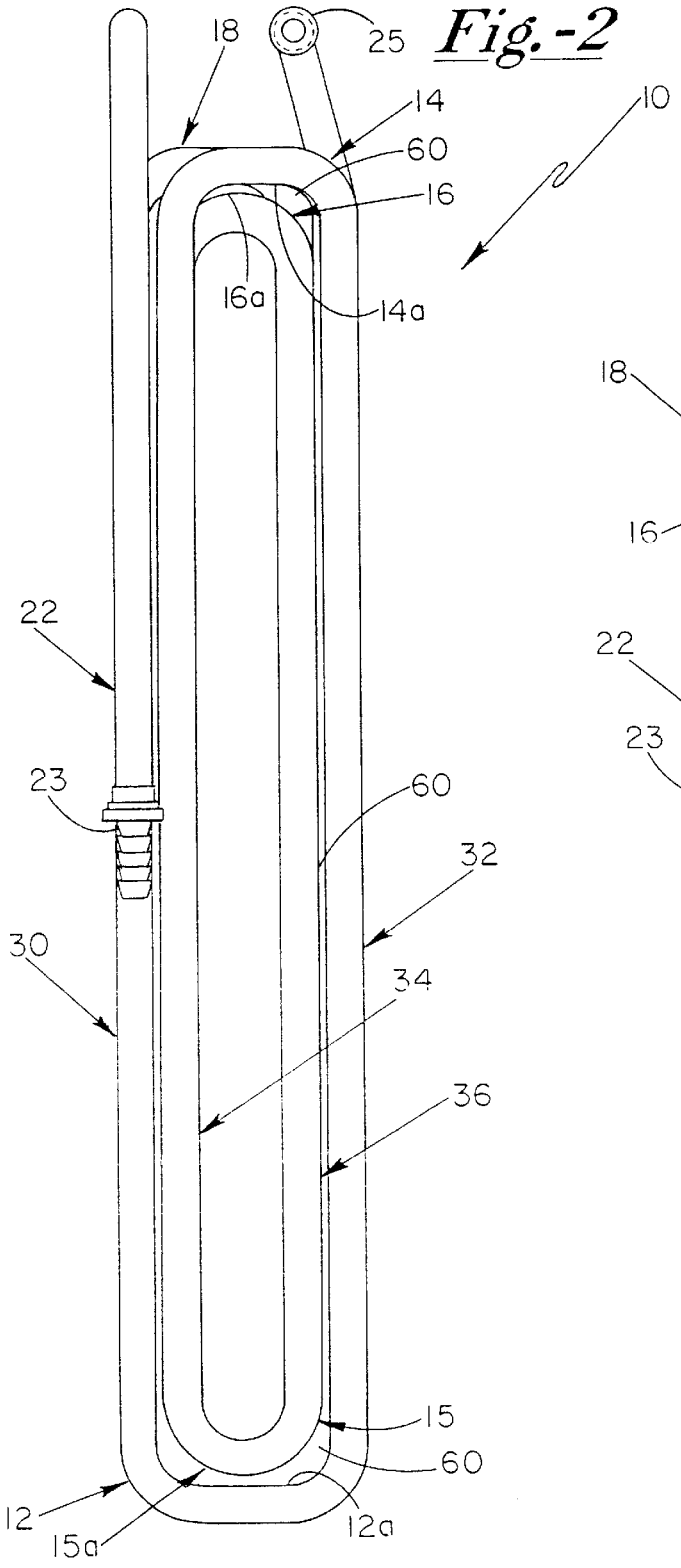
FIG. 2. shows a front plan view of the present invention.

The coil of the present invention is seen in the various figures and indicated by the numeral 10. Coil 10 includes a first large arcuately bent section 12, a medium arcuately bent section 14, three successive small arcuately bent sections 15, 16 and 17 of equal size, a further medium arcuately bent section 18 equal in size to that of arcuate section 14, and a final large arcuately bent section 20 equal in size to section 12. Coil 10 includes an inlet end portion 22 having an inlet hose fitting 23, and an outlet end portion 24 having a valve fitting 25.

Figure 5:
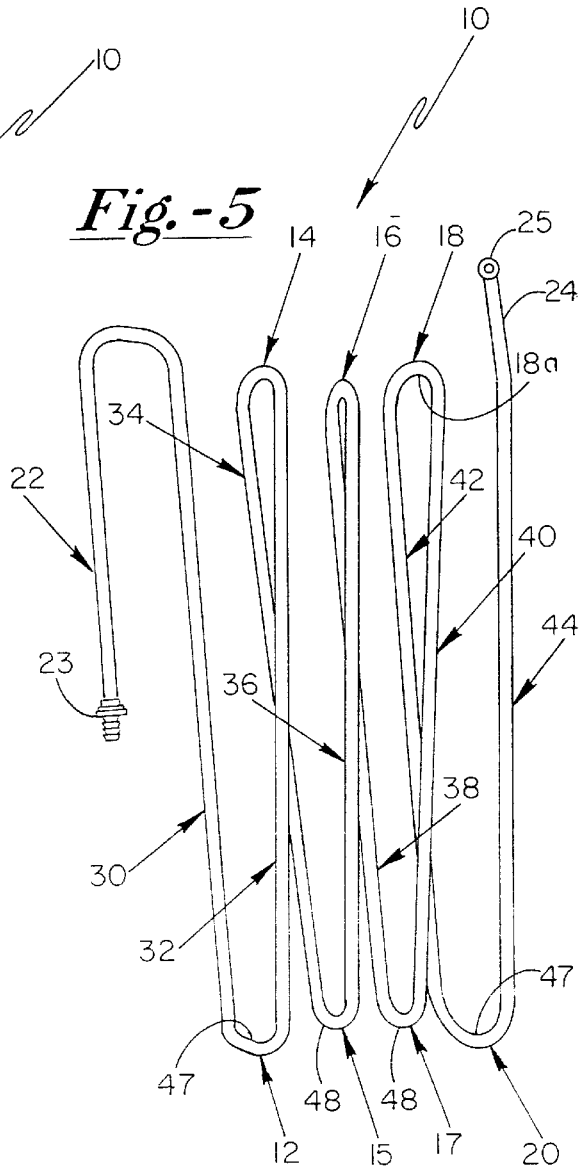
FIG. 5. shows a perspective view of the present invention in expanded form.

Section 12 defines an inner arcuate perimeter surface 12*a* having a diameter slightly greater than that of the outer perimeter surface 15*a* of medium section 15. Likewise, section 20 has an inner arcuate surface 20*a* that is slightly greater in diameter than that that of the outer surface 17*a* of section 17. Medium sections 14 and 18 are of the same size and extend through arcs of diameters in between that of large sections 12 and 20 and small sections 15–17. It can be seen that the large sections 12 and 20 and medium sections 14 and 18 are U-shaped rather than more fully semi-circular as with small sections 15–17. The actual shape of the section Straight or longitudinal tube portions 30, 32, 34, 36, 38, 40, 42, and 44 extend between the arcuate sections respectively from section 12 to section 20. Thus, as seen by particularly referring to FIG. 5, coil 10 comprises four loops A, B, C and D, each extending through an arc of 360 degrees. Tube portions 30, 32, 34, 36, 38, 40, 42, and 44 are sized so that mid-points 47 of arcuate surfaces 12*a* and 20*a* are spaced from the position of midpoints 48 of surfaces 15*a* and 17*a* respectively. Similarly, an exterior surface mid-point 16*a* of arcuate portion 16 is spaced from inner surface mid-points 14*a* and 18*a* of arcuate portions 14 and 18.

It can be seen that the large sections 12 and 20 and medium sections 14 and 18 are U-shaped rather than more fully semi-circular as with small sections 15–17. The actual shape of the section is not particularly important so much as the spacing of the tube portions 30–44. Thus, tube portions 30 and 32, for example, are spaced from each other a greater distance than tube portions 34 and 36.

Figure 3:
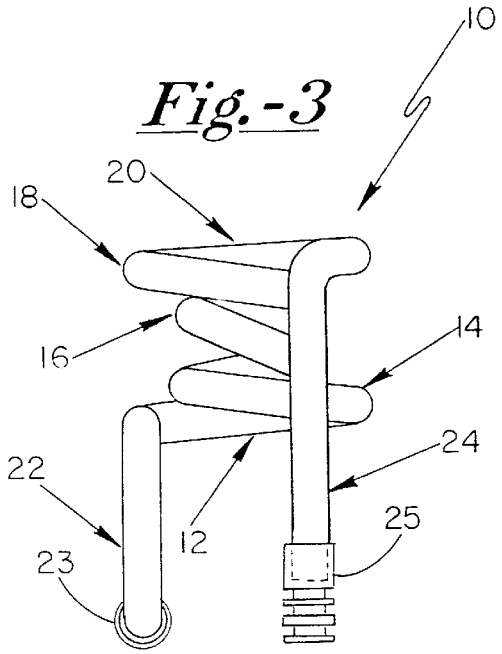
FIG. 3. shows a top plan view of the present invention.
Figure 4:
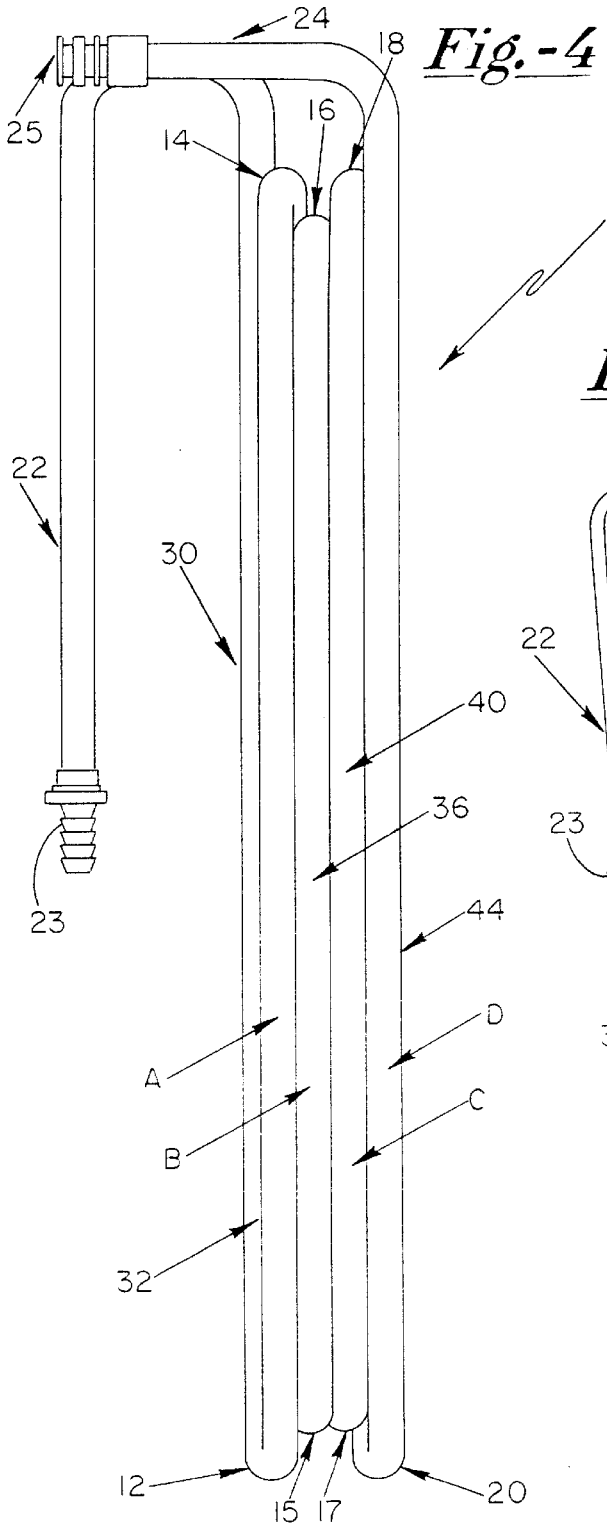
FIG. 4. shows a side plan view of the present invention.

It will be appreciated by those of skill that, in its relaxed form, the individual sub-coils A–D will naturally be slightly separated, as is seen, for example, in FIGS. 1, 3, and 4. Thus, coil 10 as a consequence of its bending formation out of an originally straight piece of tubing, is structured somewhat like a compression spring. However, this spring effect is only a very slight and coil 10 can be compressed very easily.

Figure 6:
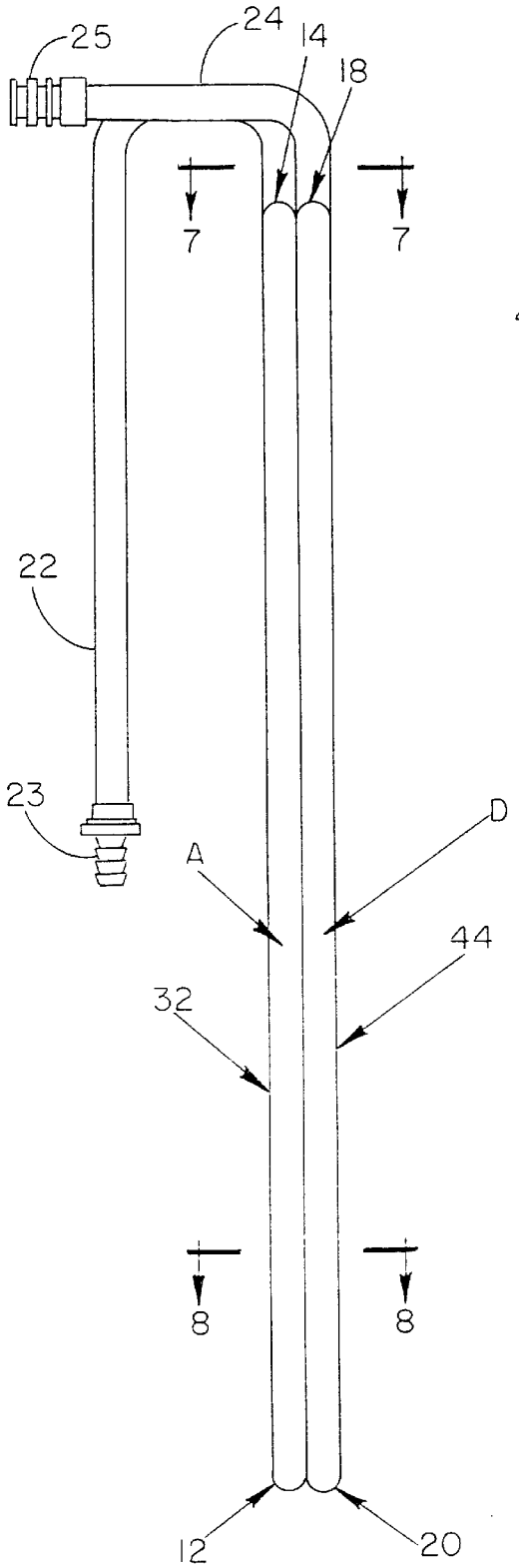
FIG. 6 shows a side plan view of the present invention in its fully compressed form.
Figure 7:
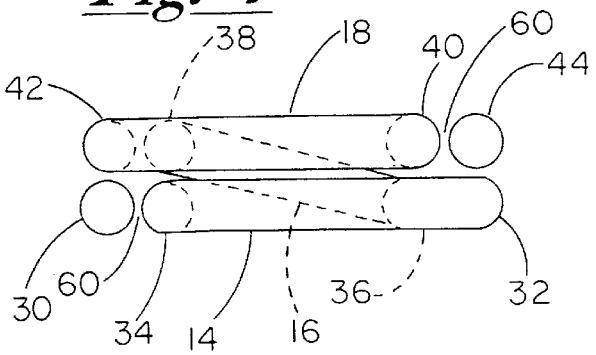
FIG. 7. shows a cross-sectional view along lines 7—7 of FIG. 6.
Figure 8:
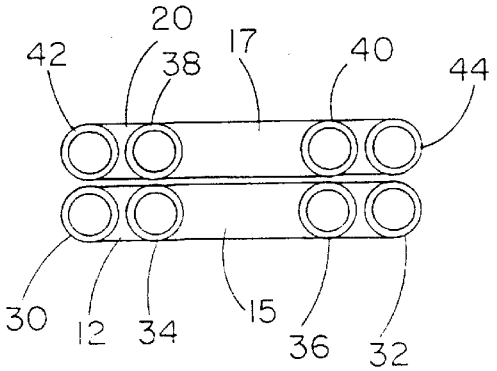
FIG. 8. shows a cross-sectional view along lines 8—8 of FIG. 6.
Figure 9:
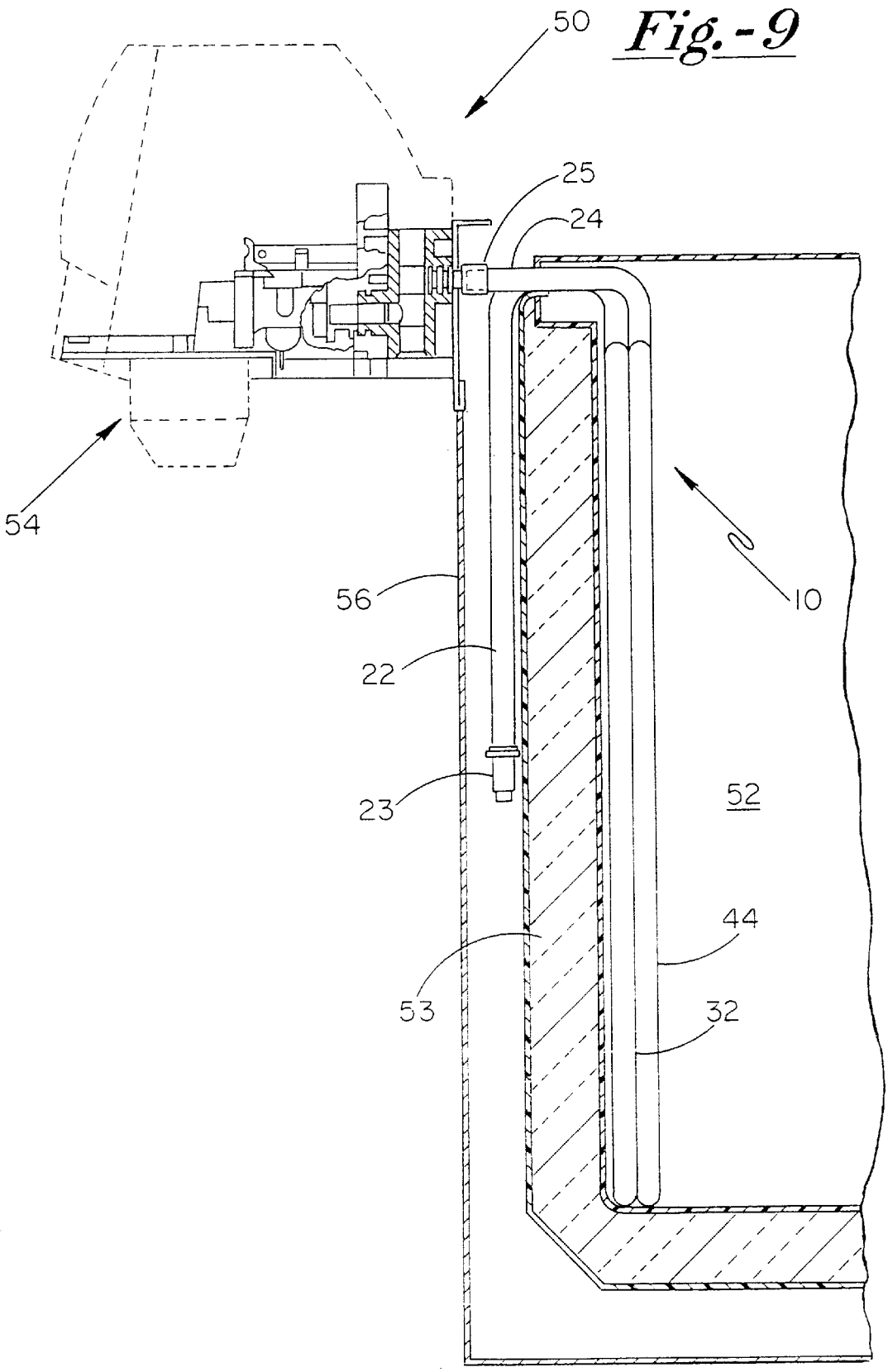
FIG. 9 shows an environmental view of the present invention as is used in a beverage dispenser.

As seen in FIG. 9, coil 10 of the present invention is used in a beverage dispensing machine 50. Dispenser 50 includes a cooled water bath tank area 52 defined by walls 53, and a beverage dispensing valve 54 secured to an outer housing surface 56. As seen therein, coil 10 is represented into its actual form as used wherein it is compressed so that it has a thickness of only two coils, that is, a depth of twice the tube diameter. Coil 10 is held in its compressed form by attachment to valve 54 by the bending thereof whereby inlet end 22 extends over and along wall 53 and by other retaining means within tank 52. How this more compact form can occur can be better understood by also referring to FIGS. 6–8. As seen therein, coils B and C fit within a coil interior area 60 within coils A and D. Coils A and B can be perceived to extend in substantially a same plane P1, and coils C and D can be understood to extend in substantially a same and separate parallel plane P2. It can be seen in FIG. 8, that small arc portions 15 and 17 fit within large arc portions 12 and 20 in the interior area 60. Thus, at the bottom end of coil 10, arc portions 15 and 17 face up against each other as do arc portions 12 and 20. However, small arc portion 16 can not fit within either medium arc portion 14 or 18 individually in the same manner as with, for example, arc portion 15 and arc portion 12, because the diameters thereof are not compatible in that manner. Compression at this top end of coil 10 is accomplished because arc portion 16 comprises a transition segment where coil B connects with coil C. Thus, as seen in FIG. 7, arc portion 16 exists at an angle and represents the transition between planes P1 and P2. As also seen in FIG. 7, arc portions 14 and 18 are faced up or contacting each other, but are also slightly offset. This offsetting of arc portions 14 and 18, combined with the angular orientation of arc portion 16 and the fact that the midpoint 16*a* is spaced from midpoints 14*a* and 18*a*, allows arc portion 16 to fit "within" arc sections 14 and 18 in the interior area 60. Thus, coil 10 in the fully compressed configuration, even though having four individual coils each extending through a full rotation of 360 degrees has a depth equal to that of two coils.

In a preferred embodiment where 5/16 inch OD stainless tubing is used, coil 10 will occupy a volume of approximately 15 cubic inches and will include approximately 8 lineal feet of tube. Using a conventional coil architecture, the same lineal footage would require approximately 20 cubic inches of water bath volume. Moreover, with respect to the number of individual coil layers thereof, there is a substantial advantage as the number of layers of coils of the present invention is one half that of a conventionally wound coil. Thus, the depth dimension of the present invention is one-half that of a standard coil. This depth dimension is the more critical dimension for a coil used in a beverage dispenser, as opposed to height or width thereof, because of the proportionately greater incursion of the coil volume into the water bath represented by the number of layers of coils. Thus, the present invention provides for a much greater liquid cooling capacity in terms of volume of beverage that can be held in the water heat exchange bath than is found in current art beverage dispensers, and do so in a manner that minimizes the incursion thereof into the water bath.

I claim:

1. A heat exchange coil comprising:

a length of tubing having a diameter and an inlet end and an outlet end, the tubing having a first large bend following the tubing inlet end, a first medium bend in the tubing following the first large bend and having a first longitudinal length of tubing there between, the first medium bend sized smaller than the first large bend by comprising a section of the tubing having a shorter length than a section of the tubing comprising the first large bend, a first small bend in the tubing following the first medium bend and having a second longitudinal length of tubing extending there between, the first small bend sized smaller than the first medium bend by comprising a section of the tubing having a shorter length than a section of the tubing comprising the first medium bend, a second small bend in the tubing following the first small bend and having a third longitudinal length of tubing extending therebetween, the second small bend utilizing a length of the tubing equal to that of the first small bend, a third small bend in the tubing following the second small bend and having a fourth longitudinal length of tubing extending therebetween, the third small bend utilizing a length of the tubing equal to that of the second small bend, a second medium bend following the third small bend and having a fifth longitudinal length of tubing extending therebetween, the second medium bend utilizing a length of the tubing equal to that of the first medium bend, a second large bend following the second medium bend and having a sixth longitudinal length of tubing extending therebetween, the second large bend utilizing a length of the tubing equal to that of the first large bend, the tubing outlet end following the second large bend, and the first and second large bends, the first and second medium bends and the first, second and third bends all extending substantially through an arc of 180 degrees whereby the tube is formed into a plurality of coils, and the first and sixth tubing sections being of equivalent length, the second and fifth tubing sections being of equivalent length and the third and fourth tubing sections being of equivalent length, and the first and sixth tubing sections longer than the second and fifth tubing sections and the second and fifth tubing sections longer than the third and fourth tubing sections so that the plurality of coils are compressible to a fully compressed orientation wherein the first and second large bends abut each other, the first and second medium bends abut each other and the first and third small bends abut each other wherein the first and third small bends are positioned within a compressed coil interior area adjacent and interior of the first and second large ends and wherein the second small bend is positioned within the coil interior area adjacent and interior of the first and second medium bends whereby the total width of the coils is approximately equal to twice the diameter of the tube.

* * * * *